US006520140B2

(12) United States Patent
Dreymüller et al.

(10) Patent No.: US 6,520,140 B2
(45) Date of Patent: Feb. 18, 2003

(54) METHOD OF OPERATING AN INTERNAL COMBUSTION ENGINE

(75) Inventors: Stefan Dreymüller, Stuttgart (DE); Thomas Ganser, Wernau (DE); Thomas Monninger, Eisingen (DE); Andreas Schmidt, Mühlacker (DE)

(73) Assignees: DaimlerChrysler AG, Stuttgart (DE); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/863,573

(22) Filed: May 23, 2001

(65) Prior Publication Data

US 2002/0023615 A1 Feb. 28, 2002

(30) Foreign Application Priority Data

May 24, 2000 (DE) ..... 100 25 665

(51) Int. Cl.[7] ..... F02B 77/00
(52) U.S. Cl. ..... 123/198 F
(58) Field of Search ..... 123/198 F

(56) References Cited

U.S. PATENT DOCUMENTS 4,207,855 A * 6/1980 Phillips ..... 123/198 F
4,305,249 A 12/1981 Schmid et al.
5,195,485 A * 3/1993 Jensen et al. ..... 123/198 F
5,562,086 A * 10/1996 Asada et al. ..... 123/198 F
6,125,812 A * 10/2000 Garabedian ..... 123/198 F
6,305,344 B1 * 10/2001 Perry ..... 123/198 F

FOREIGN PATENT DOCUMENTS

DE 44 21 257 12/1995

* cited by examiner

*Primary Examiner*—Noah P. Kamen
*Assistant Examiner*—Jason Benton
(74) *Attorney, Agent, or Firm*—Klaus J. Bach

(57) ABSTRACT

In a method for the operation of an internal combustion engine either on all cylinders (as full engine) or with only some cylinders in operation (cylinder cut-off), the cylinders are divided, in the firing order, into two groups of alternating cylinders which are selectively operative with an angular ignition spacing twice that of the cylinders of the engine when operating as full engine, the two groups of cylinders being activated alternately during engine operation with cylinder cut-off.

6 Claims, 1 Drawing Sheet

METHOD OF OPERATING AN INTERNAL COMBUSTION ENGINE

BACKGROUND OF THE INVENTION

The invention relates to a method of operating an internal combustion engine selectively either on all cylinders or with only certain cylinders in operation.

A number of internal combustion engines are known which can be operated either on all engine cylinders (full engine) or with certain cylinders cut off. Cylinder cut-off is used in particular in large capacity internal combustion engines with more than six cylinders in order to improve the engine operating efficiency under partial load operating conditions. By means of the cylinder cut-off, some of the cylinders, namely the group of cut-off cylinders, are excluded from performing work, so that the remaining group of operative cylinders that continue to fire even in the event of cylinder cut-off are operated at increased specific load with correspondingly better specific fuel economy, whilst maintaining the required engine power output at improved operating efficiency. This advantage is offset by the disadvantage that, over the life of the internal combustion engine, this results in unequal operating times for the group of cut-off cylinders and the group of operating cylinders, which continue to fire even in the event of cylinder cut-off. Such operation results in correspondingly unequal wear of the components involved in the charge cycle and in performing work. The group of inoperative cylinders cools during the periods in which they are cut off, resulting in increased friction, a tendency to form deposits and, depending on the design of the exhaust line, difficulties in maintaining a uniformly high exhaust gas temperature level, which is necessary for exhaust emission control by means of catalytic converters, especially when switching again back to full engine operation.

In internal combustion engines with cylinders divided into a group of cylinders that can be made inoperative and a group of cylinders which are always operating as disclosed for example by DE 44 21 257 A1, attempts are made to counter the latter difficulties by also maintaining the charge cycle for the cut-off cylinders during cylinder cut-off operation. In this case only the fuel supply is cut off, and the overall exhaust system is designed so that the air flowing through the inoperative group of cylinders is heated by the exhaust gases of the group of cylinders which are operating.

It is the object of the present invention to provide a method for the operation of an internal combustion engine selectively either with all cylinders operating or with certain cylinders made inoperative in such a way that unequal loads and unequal wear of the individual groups of cylinders as well as greater fluctuations of the exhaust gas temperatures resulting from the cylinder cut-off are avoided.

SUMMARY OF THE INVENTION

In a method for the operation of an internal combustion engine either on all cylinders (as full engine) or with only some cylinders in operation (cylinder cut-off), the cylinders are divided, in the firing order, into two groups of alternating cylinders which are selectively operative with an angular ignition spacing twice that of the cylinders of the engine when operating as full engine, the two groups of cylinders being activated alternately during engine operation with cylinder cut-off.

If no preferences are set, the alternating cut-off of the groups of cylinders leads to essentially equal running times for the groups of cylinders. When the engine is operating on all cylinders, the cylinders of both groups are operative. For partial cylinder operation, the running times for the cut-off of the groups of cylinders can be selected in a way that the fluctuations in exhaust emission temperatures by and large remain in a range as needed for proper operation of the exhaust emission control devices, especially the catalytic converters. This is facilitated, according to the invention, in that the operating cycle elements (valves and ignition) for the group of the cylinders made inoperative at any given time are shut down, so that the charge cycle for the inoperative group of cylinders is interrupted. In such a solution moreover prevents pumping losses that adversely affect the efficiency of the internal combustion engine.

The method according to the invention does not affect the capability to switch to full engine operation at any time according to demand, that is, as a function of the required power output. But even under the given conditions differences may occur in the operating times of the groups of cylinders. Given a continuing existence of the operating conditions permitting cylinder cut-off operation, the invention therefore limits the duration of the operating period for a group of cylinders operating at any one time. The limit is determined either as a function of time, or as a function of certain operating parameters of the internal combustion engine including the associated exhaust system, or by a combination of time and operating parameters. It is thus possible, within the scope of the invention, to influence and, in particular, to provide a maximum time for the operating period of a group of cylinders which operate during cylinder cut-off, subject to driving and/or other operating parameters.

During an extended operating condition permitting cylinder cut-off operation, the switch from one to the other group of cylinders can, according to the invention, be effected without interruption. However, an especially effective way resides in the intercalation of an operating period in which the internal combustion engine is operated as full engine. This has proved effective with a view to obtaining the most uniform output conditions possible for all cylinders during the respective cut-off mode of operation when a change between the groups of cylinders is initiated. Moreover, this also improves the switchover comfort.

The full engine operating period proposed as intermediate phase when changing from the operation of one group of cylinders to the operation of another group of cylinders can be kept very brief. In particular, it may be significantly shorter than the pre-set the maximum period of operation for a group of cylinders during a continuing existence of operating conditions permitting cylinder cut-off operation.

The method according to the invention has been found effective, especially in connection with internal combustion engines having more than six cylinders. Large capacity internal combustion engines are especially suitable for application of the method.

Thus it proves effective, for example, to apply the invention to an 8-cylinder engine, especially an 8-cylinder V-engine. The cylinders of a V8 engine are numbered, looking at the engine from the front, 1, 2, 3, 4 for the left bank of cylinders an 5, 6, 7, 8 for the right bank of cylinders. In that case, two cylinder groups can be formed, the cylinders of each of which have the same angular ignition spacing from one another. Divided into two groups in the firing order, the angular ignition spacing for the operating mode with cylinder cut-off, however, is twice the angular ignition spacing during full-engine operation. Thus for an 8-cylinder engine with the firing order 1-5-4-2-6-3-7-8, for example, this results in two groups of cylinders (1+4+6+7) for one group of cylinders and (2+3+8+5) for the other group. The cylinders are selected in the firing order. The cylinder cut-offs of the two groups are initiated alternately.

The method according to the invention can be implemented virtually without any additional cost especially in connection with internal combustion engines having individually actuated charge cycle control elements. It is possible, for example and advantageous to use valves with solenoid actuation as charge cycle control elements. With this type of valve actuation, it is possible at any time to keep the valves of the cut-off cylinders closed for the duration of the cut-off operating mode, so that a charge cycle is omitted, the associated losses due to the charge cycle work are avoided and shorter operating times with corresponding reduced wear are achieved for the charge cycle control elements. Upon switching from the cut-off operating mode to all cylinder operation, actuation of the valves can be resumed according to the normal valve timing.

Further details and features of the method according to the invention will become apparent from the following description of the invention with reference to the enclosed drawings.

DESCRIPTION OF A PREFERRED EMBODIMENT

Figure 1:
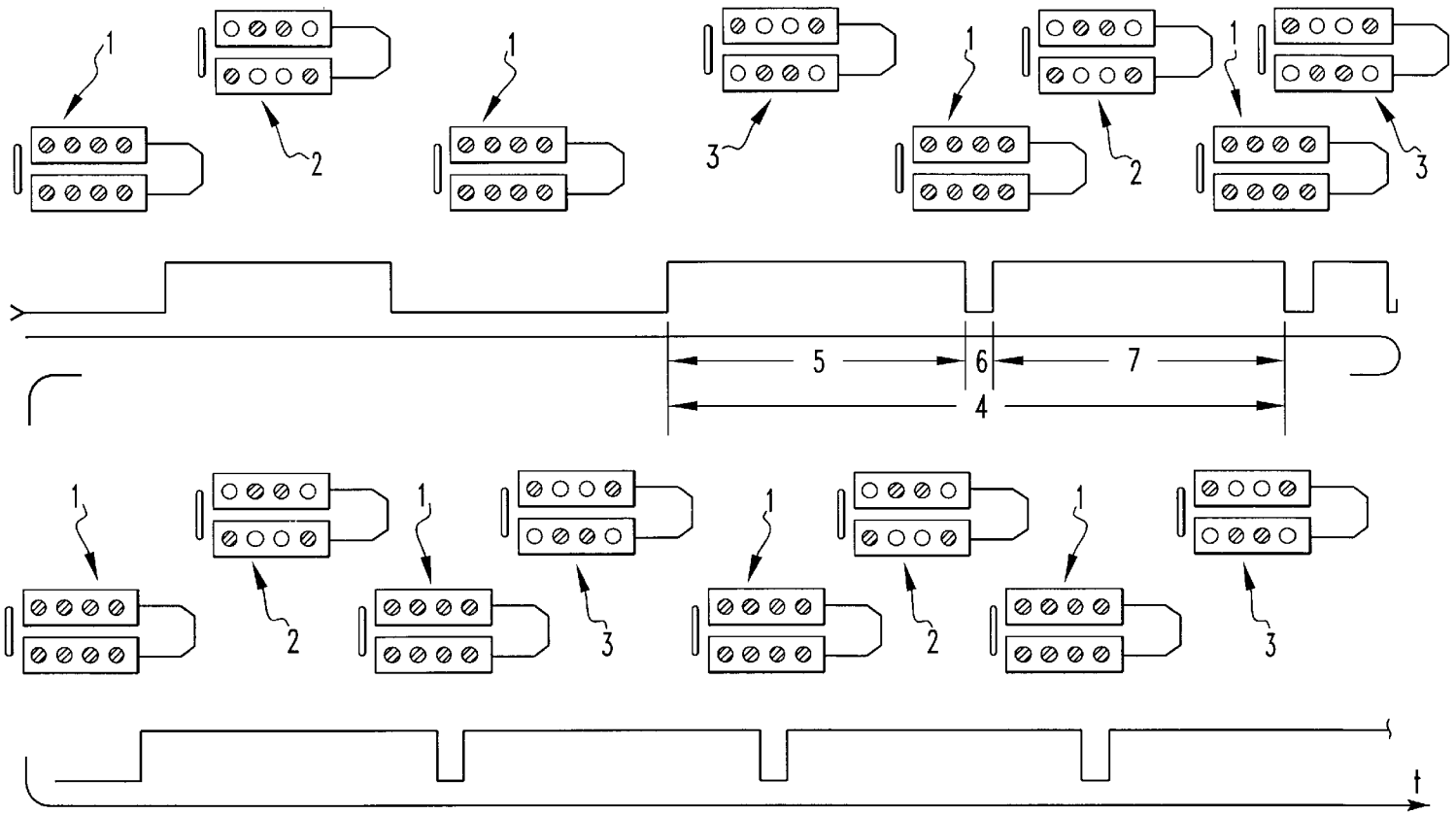
FIG. 1 is a schematic diagram showing the method according to the invention.
Figure 2:
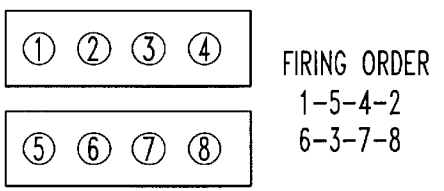
FIG. 2 shows the cylinder No. identification.

In the schematic diagram, the method according to the invention is explained on the basis of an operating diagram for a V8 internal combustion engine. The eight cylinders are indicated as circles, the area of a circle being shaded to indicate the firing condition and being left blank to indicate the inoperative condition.

If the engine is operated with all cylinders operative, the "full engine operating condition" is indicated by the engine diagram 1: all eight cylinders are firing. The firing order for the cylinders with identical angular ignition spacing in the exemplary embodiment is 1-5-4-2-6-3-7-8.

For operation with cylinder cut-off, the cylinders are divided into two groups, with each of which the engine can be operated in the event of correspondingly reduced output requirements. One group of cylinders in the exemplary embodiment shown, relative to the aforementioned firing order, comprises cylinders 2, 3, 8 and 5 and the other group cylinders 1, 4, 5 and 7 in their firing order sequence. The operating configuration of the engine with cylinder cut-off is indicated in the schematic engine diagram. The reference number 2 indicates an engine configuration in which the cylinders 2, 3, 8 and 5 (in their firing order) are operative. The reference number 3 indicates an engine configuration in which the cylinders 1, 4, 6 and 7 (in their firing order) are operative.

The staggered time diagram for the operation of the engine indicates when the engine is operated as full engine (1), that is firing on all cylinders, and when the engine is operating with cylinder cut-off that is as partially firing engine (2 or 3). The respective operating periods are indicated over time by the staggered line L having different levels. The lower level indicates the full engine operation and on the higher level indicates that the engine is operated with cylinder cut-off.

The diagram initially proceeds from a high power requirement level that is full-engine operation (engine diagram 1). This is followed by a lower power output requirement phase, symbolized by the engine diagram 2. This operating period with a lower power output requirement is again followed by a period of higher power output requirement. The full-engine operation is again symbolized by the engine diagram 1.

There now follows a longer period of time 4 comprising three operating periods 5, 6, and 7.

Over the period 4, overall operating requirements exist, which would permit operation of the engine with cylinder cut-off.

According to the invention such extended operating period 4 is divided into a number of operating periods, in the exemplary embodiment into three operating periods, that is, an operating period 5 in which, as illustrated by the engine diagram 3, the engine is operated with firing of the cylinder group containing cylinders 1, 4, 6, and 7 listed in firing order. The operating period 5 is succeeded by a brief operating period 6, in which the engine operates as full engine (engine diagram 1). This is in turn followed by an operating period 7, in which the engine operates with cylinder cut-off, wherein cylinders 2, 3, 8 and 5 are firing, listed in firing order. The engine in this operating configuration is again symbolized by the engine diagram 2.

The operating sequence depicted for the period 4 illustrates two different points. First, operation of the engine with cylinder cut-off using the two groups of cylinder alternately is limited to a maximum of the "default" operating period. The operating periods 5, 7, which, regardless of the continuing existence of operating conditions justifying a cylinder cut-off, limit the operation of the respective cylinder group (engine diagrams 2 and 3) to a certain period. The duration of this period can be determined purely as a time function or, it also may be varied on the basis of other parameters. This is followed by switching to the other cylinder group. Such switching over can occur immediately. In the exemplary embodiment, the switch occurs with the intercalation of an operating period 6, which is relatively brief and in which the engine is operated as full engine (engine diagram 1) regardless of the prevailing operating conditions permitting cylinder cut-off operation.

The length of the operating period 7 is also equal to the predetermined maximum operating time for a cylinder group. Then there is a switch to full-engine operation (engine diagram 1) and thereafter a shorter phase in which with a continuing existence of operating conditions permitting cylinder cut-off operation. The engine is again operated with cylinder cut-off (engine diagram 3) again changing to another group of cylinders.

The second row of the schematic diagram also illustrates corresponding sequences during an extended period permitting engine operation with cylinder cut-off as described for the period 4. A detailed description is therefore not provided. The sequence of operation is again indicated by engine diagrams 1 to 3.

In the schematic diagram, a switch from one cylinder group to the other is associated with each interruption regardless of the respective period of operation with cylinder cut-off. If a switch-over is not necessitated by the set limits for the operating periods of the cylinder groups in accordance with the invention such switch-over is not obligatory. It is however advisable, since, in this way, maximum equalization of the loads is achieved both from the mechanical and from the thermal standpoints.

The method according to the invention results in a mode of operation, in which the group of operating cylinders changes with each change between full-engine operation and operation with cylinder cut-off, regardless of the respective operating period. The operating period is of course unlimited when full engine operation is required. Operating period limits are provided only when the engine is operated with cylinder cut-off.

What is claimed is:

1. A method for the operation of an internal combustion engine either selectively on all cylinders (full engine operation) or with cylinders cutoff, wherein the cylinders succeeding one another in the firing order for operation as full engine are divided into two groups of cylinders for operation with cylinder cut-off, said method comprising the steps of operating cylinders belonging to a group and succeeding one another in the firing order in each case with an angular ignition spacing twice that effective during full engine operation and, given a continuing existence of an operating condition permitting cylinder cut-off, changing operation from one group of cylinders to the other group of cylinders with an intercalation of an operating period, in which the internal combustion engine is operated as full engine, wherein the full engine operating period intercalated when changing from one group of cylinders to the other group of cylinders as the operative cylinder group is shorter than the maximum duration of an operating period of one group of cylinders.

2. A method according to claim 1, wherein each cylinder group comprises, in the firing order, alternate cylinders of said engine so that the ignition spacing for the cylinders in each group is identical in the respective mode of operation.

3. A method according to claim 1, wherein, given a continuing existence of an operating condition permitting cylinder cut-off, the duration of an operating period for each group of cylinders operating at any one time is limited.

4. A method according to claim 1, wherein, given a continuing existence of an operating condition permitting cylinder cut-off, the duration of an operating period for each group of cylinders operating at any one time is limited to a maximum time period.

5. A method according to claim 1, wherein, given a continuing existence of an operating condition permitting cylinder cut-off, the duration of an operating period for that group of cylinders operating at any one time is limited depending on engine operating parameters.

6. A method according to claim 1, wherein the internal combustion engine is operated with solenoid operated timing gear.

* * * * *